United States Patent [19]

Uehira et al.

[11] Patent Number: 4,829,748

[45] Date of Patent: May 16, 1989

[54] APPARATUS FOR ARRAYING PARTS ON RESPECTIVE TRAYS

[75] Inventors: Tetsuo Uehira, Chiba; Akira Kimura, Tokyo, both of Japan

[73] Assignee: Sony Corp., Tokyo, Japan

[21] Appl. No.: 50,553

[22] Filed: May 18, 1987

[30] Foreign Application Priority Data

May 23, 1986 [JP] Japan ..... 61-119959

[51] Int. Cl.[4] ..... B65B 1/22

[52] U.S. Cl. ..... 53/525; 53/251; 222/144; 222/196

[58] Field of Search ..... 53/250, 251, 525; 198/346.1; 222/144, 196, 197, 561; 414/415

[56] References Cited

U.S. PATENT DOCUMENTS 949,944 2/1910 O'Connell ..... 222/144
3,199,550 8/1965 Crowe ..... 53/525 X
3,777,911 12/1973 Bornfleth ..... 414/222

FOREIGN PATENT DOCUMENTS 627036 10/1978 U.S.S.R. ..... 414/415
826853 1/1960 United Kingdom .
1337931 11/1973 United Kingdom .

*Primary Examiner*—Frank E. Werner
*Assistant Examiner*—Janice Krizek
*Attorney, Agent, or Firm*—Alvin Sinderbrand

[57] ABSTRACT

An apparatus for arraying parts on respective trays therefor comprises a tray-stocking device for receiving empty trays from a conveyor and maintaining a stock of the empty trays from which the latter are individually lifted by a first elevator to a conveying line extending above the tray-stocking device past a tray-accommodating station, a parts supplying mechanism disposed adjacent such station for selectively supplying parts to an empty tray disposed thereat, a vibrator for shaking the tray disposed at the tray-accommodating station and thereby arraying the parts supplied to the tray, whereupon the tray with parts arrayed thereon is withdrawn from the station along the conveying line, and a second elevator for removing the individual trays with parts arrayed thereon from the conveying line and for returning the removed trays with parts arrayed thereon to the first-mentioned conveyor.

12 Claims, 3 Drawing Sheets

APPARATUS FOR ARRAYING PARTS ON RESPECTIVE TRAYS

BACKGROUND OF THE INVENTION

1. Field of the Invention

The present invention relates to an apparatus for arraying parts on respective trays therefor, and more particularly is directed to an apparatus of the described type that can be associated with a conveyor by which empty trays are supplied to the apparatus and trays with parts arrayed thereon are taken away.

2. Description of the Prior Art

In automatically assembling parts, for example, by means of robots, it is necessary that the parts to be assembled be arrayed in predetermined patterns and directions, for example, on trays, so that the robots can easily grasp and otherwise act on the parts to be assembled. In existing apparatus for arraying parts, there is usually provided a part feeder and a supply device receiving successive parts from the part feeder and arraying the same in a predetermined manner, for example, on a tray. In such conventional arraying apparatus, only one kind of part can be arrayed, that is, the part feeder has to be replaced when parts of a different type are to be arrayed. Further, in the supply device of the known apparatus, exchanging of the tray, that is, removal of a tray on which parts have been arrayed and its replacement by an empty tray, return of superfluous parts to the receptacle therefor in the part feeder, and modification of the pattern or other conditions to be met by the arrayed parts must all be manually performed.

OBJECTS AND SUMMARY OF THE INVENTION

Accordingly, it is an object of this invention to provide a part arraying apparatus which avoids the above-mentioned problems associated with the prior art.

More specifically, it is an object of this invention to provide a part arraying apparatus which is operable to automatically array parts on trays therefor without the need for manual intervention or operations.

Another object is to provide an apparatus, as aforesaid, which can automatically select the types of parts to be arrayed on respective trays and the arraying conditions.

In accordance with an aspect of this invention, an apparatus for arraying parts on respective trays comprises conveying means for transporting trays, tray-stocking means for receiving empty trays from such conveying means and maintaining a stock of the empty trays on which parts are to be arrayed, first elevator means for lifting the empty trays individually from the stock thereof to holding means by which the received empty tray is delivered along a conveying line which extends above the tray-stocking means past a tray-accommodating station, parts supplying means disposed adjacent such station for selectively supplying parts to an empty tray disposed thereat, means for arraying the supplied parts on the tray disposed at the station, means for withdrawing the individual trays with parts arrayed thereon from the station and along the conveying line in the direction away from the holding means, and second elevator means for removing the individual trays with parts arrayed thereon from the conveying line for return to the first-mentioned conveying means.

In a desirable embodiment of the invention, various types of trays are detected by means of a sensor, and the parts supplying means is selectively operable, in accordance with the detected type of tray, to supply respective kinds of parts to the tray disposed at the station for accommodating the same. Furthermore, the means for arraying the supplied parts, which preferably comprises a vibrator operable in various modes, is also responsive to the detected type of tray for selecting the mode of vibration that is appropriate for the types of parts to be arrayed and for the conditions thereof.

The above, and other objects, features and advantages of the invention, will be apparent in the following detailed description of an illustrative embodiment of the invention which is to be read in connection with the accompanying drawings in which the same reference numerals are used to identify corresponding parts in the several views.

DETAILED DESCRIPTION OF THE PREFERRED EMBODIMENT

Figure 1:
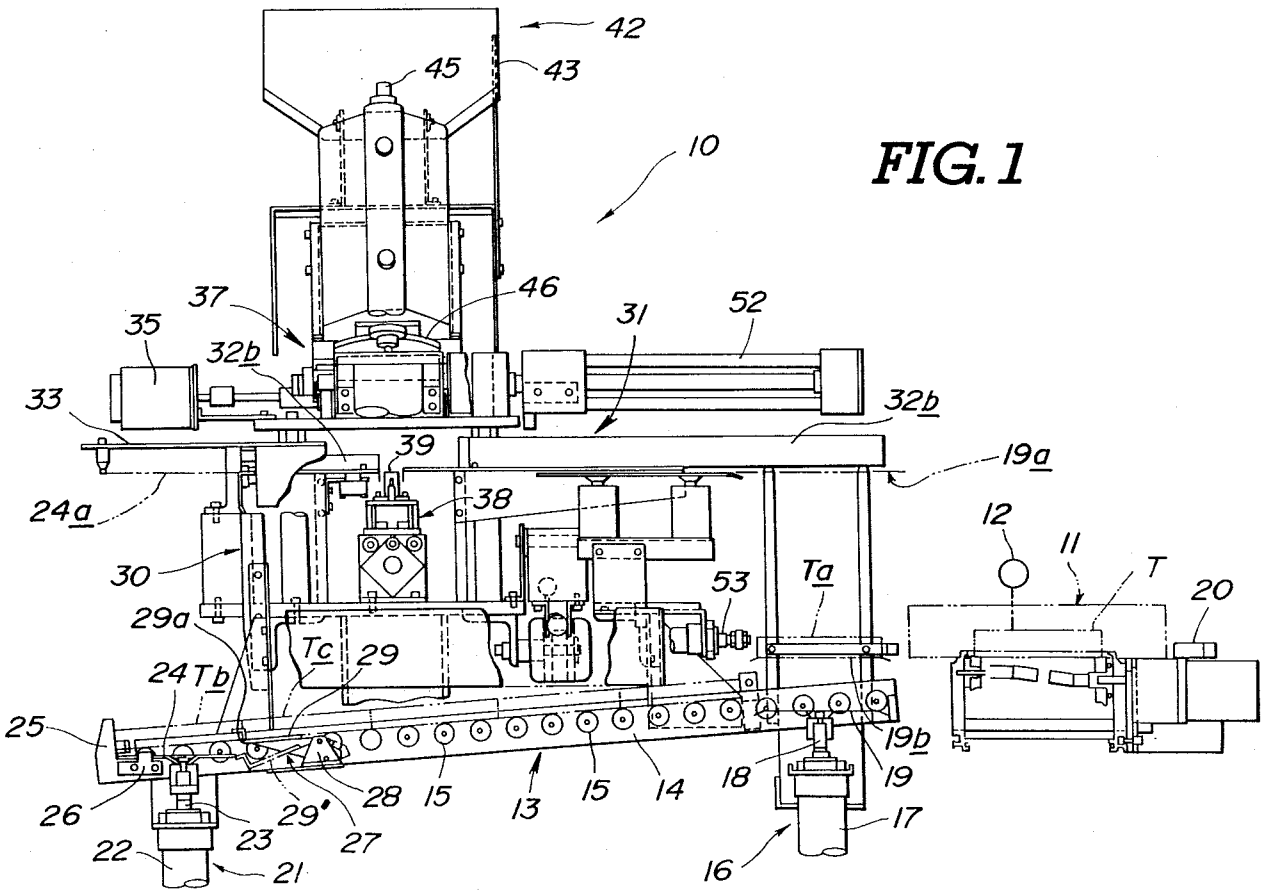
FIG. 1 is a front elevational view of a part arraying apparatus according to an embodiment of the present invention.

Referring to the drawings in detail, it will be seen that a part arraying apparatus 10 according to an embodiment of the present invention is disposed at one side of a conveyor 11 for transporting trays, for example, the empty tray indicated in dot-dash lines at T in FIG. 1. A suitable sensor 12, for example, in the form of a bar-code reader, is disposed adjacent conveyor 11 for detecting the types of empty trays T being transported thereby.

The apparatus 10 according to this invention is shown to generally comprise a tray-stocking device 13 for receiving empty trays from conveyor 11 and maintaining a stock of the empty trays on which parts are to be arrayed. In the illustrated embodiment, tray-stocking device 13 is shown to be in the form of a gravity-feed conveyor having an elongated frame 14 extending transversely with respect to conveyor 11 from a position below the adjacent side of conveyor 11 and being inclined downwardly in the direction toward the end of frame 14 remote from conveyor 11. Rollers 15 extend inwardly from the opposite sides of frame 14 at spaced apart locations along the latter and are freely rotatable. Thus, an empty tray placed on rollers 15 of device 13 adjacent the relatively high end of frame 14 will be induced, by the force of gravity, to move longitudinally along frame 14 toward the relatively low end of the latter.

An elevator 16 for transferring trays is shown on FIG. 1 to include a fluid-pressure operated linear motor, for example, in the form of an hydraulic cylinder 17, mounted vertically below the relatively high end of frame 14 and including an upwardly directed ram or rod 18 on which a tray-receiving plate 19 is mounted. Tray 19 is dimensioned so as to be movable vertically between the confronting or inwardly directed ends of rollers 15 at the relatively high end portion of frame 14. Thus, tray-receiving plate 19 is movable vertically between a lowered position shown in full lines in FIG. 1 and in which plate 19 is disposed below the tray supporting level of rollers 15 at the upper end portion of frame 14, as when rod 18 is fully retracted in cylinder 17, a raised position indicated in broken lines at 19*a*, as when rod 18 is fully extended, and an intermediate position indicated in broken lines at 19*b*, as when rod 18 is only fractionally extended and in which the tray-receiving plate 19*b* is at the same level as the tray-conveying surface of conveyor 11 for the transfer of trays therebetween.

A pusher 20 (FIG. 1) is provided at the side of conveyor 11 remote from apparatus 10 at a position along conveyor 11 that is substantially laterally aligned with elevator 16. When tray-receiving plate 19 is in its intermediate position indicated at 19*b* on FIG. 1, pusher 20 is operable to push a tray T laterally off conveyor 11 and onto receiving plate 19*b* so that the tray then occupies the position indicated in dot-dash lines at Ta. If rod 18 is thereafter fully retracted into cylinder 17 for moving plate 19 to the lowered position shown in full lines in FIG. 1, the tray supported by plate 19 is deposited on the freely rotatable rollers 15 at the upper end portion of frame 14 and, as previously noted, will be induced by gravity to move longitudinally along frame 14 toward the relatively low end of the latter. Frame 14 is seen to be of sufficient length so that a plurality of trays, for example, five trays as in the illustrated embodiment, can be accommodated in a line extending from the high end toward the low end of frame 14 for maintaining a stock of the empty trays on device 13.

An elevator 21 for transferring empty trays from tray-stocking device 13 is shown to include a fluid-pressure operated linear motor, for example, in the form of an hydraulic cylinder 22, mounted vertically below the relatively low end of frame 14 and including an upwardly directed ram or rod 23 on which a tray-receiving plate 24 is mounted. Tray 24 is dimensioned so as to be movable vertically between the confronting or inwardly directed ends of rollers 15 at the relatively low end portion of frame 14. Thus, tray-receiving plate 24 is movable vertically between a lowered position shown in full lines in FIG. 1 and in which tray 24 is disposed below the tray-supporting level of rollers 15 at the lower end portion of frame 14, as when rod 23 is fully retracted in cylinder 22, and a raised position indicated in broken lines at 24*a*, as when rod 23 is fully extended. It will be appreciated that, when plate 24 is in its lowered position, the empty tray Tb at the head end of the line of trays on stocking device 13 can move downwardly along frame 14 over plate 24 so as to abut against a stop 25 at the relatively low end of frame 14. Thereafter, as when a sensor 26 detects the presence of empty tray Tb on rollers 15 at the lower end portion of frame 14, elevator 21 is made operative to fully extend its rod 23 for moving tray-receiving plate 24 vertically upward to its raised position shown at 24*a* and correspondingly lifting the tray Tb thereabove.

In order to ensure that, when tray Tb is lifted by movement of plate 24 to its raised position, the tray Tc next in line on stocking device 13 will not move further toward the lower end of frame 14 and thereby interfere with the subsequent return of plate 24 to its lowered position, apparatus 10 is further shown on FIG. 1 to include a tray-stopping device 27. More particularly, device 27 is movable by plate 24 to an inoperative position in which it is out of the path of travel of trays on device 13 when plate 24 is in its lowered position, and, in response to movement of plate 24 to its raised position, device 27 is made operative to engage the tray Tc next in line for preventing further gravity feed of the trays toward abutment 25. In the illustrated embodiment, tray-stopping device 27 is shown to include a bracket 28 secured to frame 14 below the path of travel of the trays on rollers 15, and a lever 29 pivoted on bracket 28 for rocking movements between an operative position, shown in full lines on FIG. 1, in which lever 29 extends immediately below tray Tc and engages the latter at the leading or downhill side of the tray by means of an upwardly directed flange 29*a* at the free end of lever 29, and a depressed or downwardly deflected inoperative position, shown in broken lines at 29' on FIG. 1, and in which flange 29*a* is below the path of movement of trays on rollers 15 so as to avoid interference therewith. The lever 29 is preferably biased, as by a spring, not shown, to its operative position shown in full lines on FIG. 1, and flange 29*a* on lever 29 is preferably provided with a lip extending therefrom to be engageable from above by an adjacent edge portion of plate 24 for moving lever 29 to its inoperative position in response to the return of tray-receiving plate 24 to its lowered position. Thus, when plate 24 is moved upwardly to its raised position for similarly elevating tray Tb at the head end of the line of trays on device 13, tray-stopping device 27 is operative to hold tray Tc that is next in line in the position illustrated. Thereafter, when plate 24 is returned downwardly to its lowered position, lever 29 of device 27 is displaced to its downwardly deflected inoperative position so that the tray Tc can move further downwardly along rollers 15 to the position against abutment 25, and thereby provide space on device 13 for an additional tray at the end portion of frame 14 adjacent conveyor 11.

The apparatus 10 according to this invention further comprises a substantially horizontal conveying line 31 extending above tray-stocking device 13 on a frame 30 and also being arranged transversely with respect to the direction of movement of the trays on conveyor 11. The conveying line 31 is shown to include guide rails 32*a* and 32*b* extending along the opposite sides of conveying line 31 and being spaced apart for suitably guiding and supporting the individual trays during movement along conveying line 31. The guide rail 32*a* is divided, at its mid-portion, to define a gap (not shown) through which each tray can be moved in and out of conveying line 31, as hereinafter described in detail. Conveying line 31 is further shown to have a holding plate 33 reciprocable along conveying line 31 from and to a tray-receiving position shown in the drawings. The holding plate 33 is formed with a tray-receiving cutout 34 (FIGS. 2 and 3) having an opening 34*a* at the side of conveying line 31 constituted by rail 32*a*. Suitable drive means, for example, as indicated at 35 in FIG. 1, is connected with holding plate 33 for effecting the reciprocal movements of the latter in the direction along conveying line 31. When tray Tb at the head end of the line on tray-stocking device 13 is lifted from the latter by the movement of tray-receiving plate 24 to its raised position indicated at 24*a* in FIG. 1, the raised tray is inserted, from below, in cutout 34 of holding plate 33. Thereafter, when holding plate 33 is displaced along conveying line 31 in the direction of the arrow 36 on FIG. 2, the tray in cutout 34 is moved slidably off the raised plate 24*a* and engaged, at its opposite sides, by guide rails 32*a* and 32*b*. The movement of holding plate 33 in the direction of arrow 36 brings the tray within cutout 34 to a middle position along conveying line 31 at which the gap is provided between the portions of guide rail 32*a*. After holding plate 33 has been displaced in the direction of arrow 36 to an extent sufficient to cause rails 32*a* and 32*b* to slidably support the tray, tray-receiving plate 24 can be returned from its raised position indicated at 24*a* (FIG. 1) to its lowered position 24.

A structure 37 suitably supported on frame 30 is interposed in the gap between the portions of guide rail 32*a* and extends from conveying line 31 to define a tray-accommodating station. A transferring mechanism 38 is provided below conveying line 31 at the location along the latter corresponding to station 37. The transferring mechanism 38 includes an upwardly directed actuating pin 39 that is engageable from below with a tray moved by holding plate 33 to the position of station 37. Then, mechanism 38 is operable to transfer the tray from cutout 34 in plate 33 through the gap in guide rail 32*a* into tray-accommodating station 37. After suitable parts have been arrayed on the tray at station 37, as hereinafter described, mechanism 38 is operable to return the tray with arrayed parts thereon to conveying line 31.

At station 37 there is provided a vibrator 40 which is selectively operable in various vibrating modes for correspondingly vibrating the tray transferred to station 37. Further, at station 37 there is provided a device 41, for example, in the form of a tiltable table, for inclining the tray Td disposed at station 37 in the direction downwardly away from conveying line 31. A parts supplying mechanism 42 is mounted above conveying line 31 adjacent station 37 for selectively supplying parts to tray Td disposed at such station. In the illustrated embodiment, the parts supplying mechanism 42 is shown to include an hexagonally shaped magazine 43 defining six separated receptacles 44 for containing six different types of parts. The magazine 43 is selectively rotatable about a central post 45 for aligning a selected one of the receptacles 44 with a gate 46 operable, as by a solenoid 47 (FIGS. 2 and 3), for permitting discharge of parts from the selected receptacle 44 through gate 46 and onto the inclined tray Td. When inclined tray Td is vibrated, the parts discharged from the selected receptacle 44 through gate 46 flow across tray Td and are arrayed on the latter. The superfluous parts flowing across tray Td are directed by a chute 48 into a parts return mechanism 49 which returns the superfluous parts to the corresponding receptacle 44, as indicated by the arrows 50 on FIG. 3.

Figure 2:
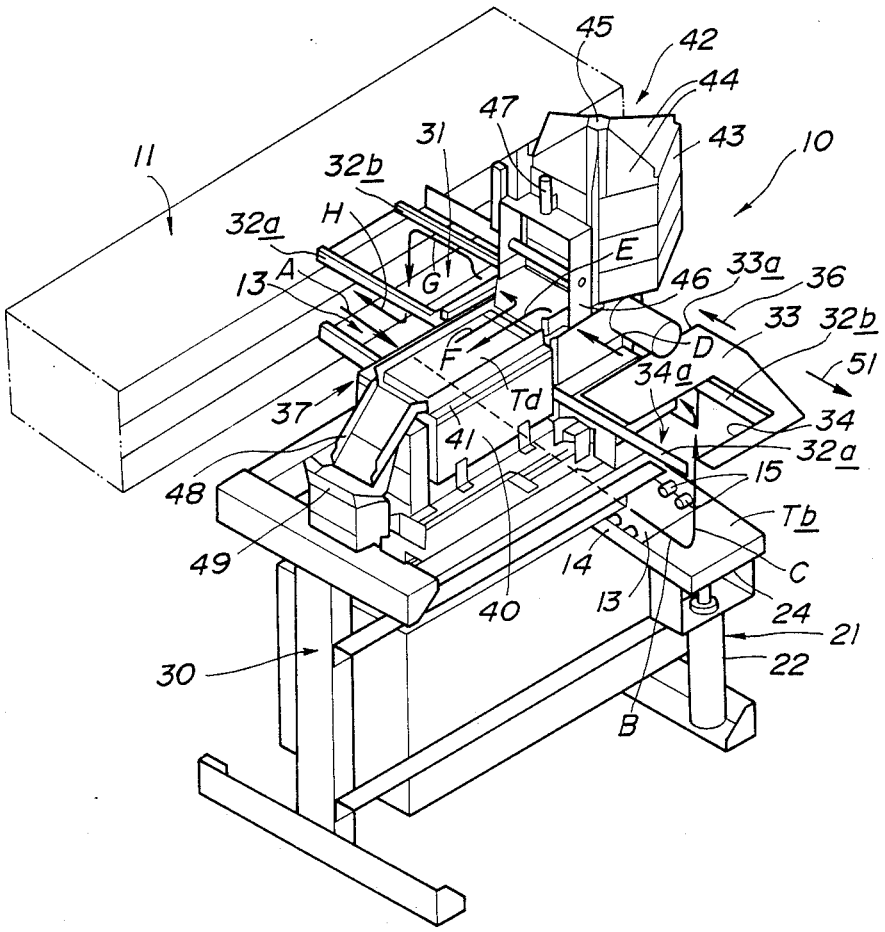
FIGS. 2 and 3 are perspective views of the apparatus shown on FIG. 1 and which respectively illustrate the paths of trays in such apparatus, and the paths of parts to be arrayed on the trays.
Figure 3:
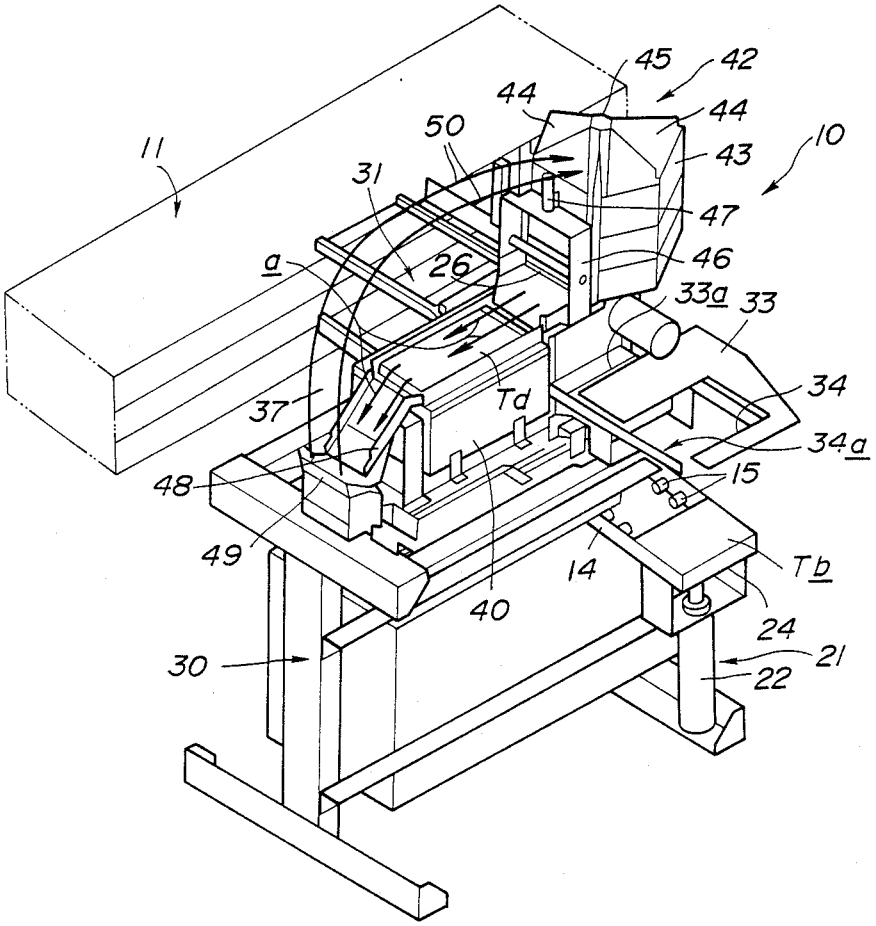

While parts are being arrayed on a tray at station 37, holding plate 33 is returned in the direction of the arrow 51 in FIG. 2 to the position there shown, that is, to its tray-receiving position for receiving another tray lifted by plate 24. After the arraying of parts on a tray at station 37 has been completed, the operation of vibrator 40 is halted and tiltable table 41 is returned to its horizontal position. Then, transferring mechanism 38 is operated to return the tray with parts arayed thereon to conveying line 31. Thereafter, when holding plate 33 is displaced in the direction of the arrow 36 in FIG. 2 for moving a new tray in cutout 34 to the position of station 37, the leading edge 33*a* of holding plate 33 propels the tray with parts arrayed thereon ahead of plate 33 along conveying line 31. When the tray with parts arrayed thereon has been thus moved out from under parts supplying mechanism 42, a tray-pushing cylinder 52 (FIG. 1) is made operative for further propelling that tray along conveying line 31 to a terminal end position above the location of elevator 16. As the tray with parts arrayed thereon is thus propelled to the terminal end of conveying line 31, it is released from the guide rails 32*a* and 32*b* of conveying line 31 and supported on plate 19 of elevator 16 which is then at its raised position indicated in broken lines at 19*a* in FIG. 1. Thereafter, the tray-receiving plate 19 is lowered to its intermediate position indicated in broken lines at 19*b*, and a tray pusher 53 is made operative to propel the tray with parts arrayed thereon off plate 19*b* and back onto conveyor 11 for further transport by the latter away from the part arraying apparatus 10 according to this invention.

The sequential operations of the part arraying apparatus 10 according to this invention will now be described:

As an empty tray T is transported by conveyor 11, the type of such tray is detected by sensor 12. Then, the empty tray is pushed laterally off conveyor 11 in the direction of arrow A (FIG. 2) by pusher 20 onto tray-receiving plate 19 which is at its intermediate position 19*b*. Thereafter, elevator 16 is operated to displace plate 19 to its lowered position and thereby deposit the tray Ta onto rollers 15 at the relatively high end of tray stocking device 13. The successive trays move along device 13 in the direction toward the lower end thereof, as indicated by the arrow B. When a tray Tb at the head end of the line of trays on device 13 is detected by sensor 26, elevator 21 is operated to move the respective tray-receiving plate 24 from its lowered position below tray Tb to its raised position indicated at 24*a* in FIG. 1, whereby tray Tb is lifted, as indicated by the arrow C in FIG. 2, to engage in cutout 34 of holding plate 33. Thereupon, holding plate 33 is displaced by its drive means 35 for moving the tray in cutout 34 along conveyor line 31, as indicated by the arrow D in FIG. 2. When the tray is thereby brought into alignment with the gap in guide rail 32*a*, transferring mechanism 38 is made operative to displace the tray out of conveying line 31 in the direction of the arrow E (FIG. 2) into tray-accommodating station 37. Thereafter, based upon the type of tray disposed at station 37, magazine 43 is selectively rotated to position adjacent gate 46 that receptacle 44 which contains the parts to be arrayed on such tray. Then, table 41 is tilted, and vibrator 40 is operated in the vibrating mode required for arraying such parts, while gate 46 is selectively opened to permit the discharge therethrough of at least the quantity of parts required for arraying on the tilted and vibrated tray. Thus, the discharged parts flow from gate 46 across the tilted and vibrated tray Td and into chute 48, as indicated by the arrows a in FIG. 3, so as to be returned to the respective receptacle through mechanism 49, and as indicated by the arrow 50.

When the arraying of parts on the tray at station 37 has been completed, the vibration of the tray is halted, and the inclined table 41 is returned to its horizontal position. Then, transferring mechanism 38 is operated to restore the tray with arrayed parts thereon to conveying line 31, as indicated by the arrow F in FIG. 2. When holding plate 33 is again displaced to engage its leading edge 33*a* with the tray having arrayed parts thereon, the latter is moved into the operating range of cylinder 52 which completes the displacement of the tray along conveying line 31 to its terminal end, as indicated by the arrow G in FIG. 2. Finally, the tray with parts arrayed thereon is moved downwardly from the terminal end of conveying line 31 on tray-receiving plate 19 of elevator 16 and, when such tray-receiving plate reaches its intermediate position indicated at 19*b*, pusher 53 is operative to return the tray with arrayed parts thereon to conveyor 11.

It will be appreciated that, in the apparatus 10 according to the present invention, the movements of the elevators 16 and 21, the pushers 20 and 53, the drive means 35, the transferring mechanism 38, the cylinder 52 and the magazine 43, and the operations of the vibrator 40 and tilting table 41 may all be controlled automatically in the described sequences and in response to signals from sensors 12 and 26 by means of a suitable, conventional microprocessor. Thus, the described operations of the apparatus 10 can all be automatically controlled and performed without any manual intervention other than possibly the resupplying of parts to the receptacles of magazine 43. Furthermore, since the type of tray is detected by sensor 12 as the tray is being transported on conveyor 11 to apparatus 10, various types of trays can be transported to tray-stocking device 13, and the corresponding types of parts can be stored in respective receptacles 44 of magazine 43 to be arrayed on the respective types of trays as the latter are individually positioned at station 37. It is also to be noted that the mode of vibration of each tray by vibrator 40 may be selectively determined in response to detection of the type of such tray so that the arraying of various types of parts on the respective trays can be most efficiently performed. It will also be appreciated that, since a number of empty trays, for example, five trays, are provided on the inclined tray-stocking device 13, the operations of the part arraying apparatus 10 can be smoothly performed in an uninterrupted or uniformly timed manner without interference from the possibly erratic arrival of empty trays from conveyor 11.

Although an illustrative embodiment of the invention has been described in detail herein with reference to the accompanying drawings, it is to be understood that the invention is not limited to that precise embodiment, and that various changes and modifications may be effected therein by one skilled in the art without departing from the scope or spirit of the invention as defined in the appended claims.

What is claimed is:

1. Apparatus for arraying parts on respective trays therefor, comprising:

conveying means for transporting trays;

tray-stocking means for receiving empty trays from said conveying means and maintaining a stock of the empty trays on which parts are to be arrayed;

first elevator means for lifting said empty trays individually from said stock thereof to an elevated position;

means defining a conveying line extending above said tray-stocking means from said elevated position;

means defining a tray-accommodating station at a location spaced along said conveying line from said elevated position;

holding means for receiving the individual empty trays from said first elevator means at said elevated position and for delivering each said individual tray therefrom along said conveying line to said tray-accommodating station;

parts supplying means disposed adjacent said station for selectively supplying parts to an empty tray disposed at said station;

means for arraying the supplied parts on said tray disposed at said station;

means for withdrawing the individual trays with parts arrayed thereon from said station in the direction along said conveying line away from said elevated position; and second elevator means for removing from said conveying line the individual trays with parts arrayed thereon which have been withdrawn from said station and for restoring the removed trays with parts arrayed thereon to said conveying means.

2. Apparatus according to claim 1; in which said tray-stocking means includes an elongated conveyor device having one end adjacent said conveying means for said receiving of the empty trays and being of a length sufficient to accommodate a plurality of the empty trays in a line extending from said one end to the other end of said elongated conveyor device; said first elevator means is disposed adjacent said other end of the elongated conveyor device and is operative to raise an empty tray from a head end of said line into said holding means at said elevated position; said conveying line above the tray-stocking means extends substantially parallel with said elongated conveyor device so that each of said individual trays with parts arrayed thereon, after said withdrawing from said station, is disposed above said one end of the elongated conveyor device; and said second elevator means has a raised position to receive the withdrawn tray with parts arrayed thereon from said conveying line, an intermediate position for transferring trays between said conveying means and said second elevator means and a lowered position in which an empty tray received by said second elevator means in said intermediate position from said conveying means is deposited by said second elevator means onto said one end of the elongated conveyor device.

3. Apparatus according to claim 2; further comprising pushing means selectively operable for pushing an empty tray from said conveying means onto said second elevator means in said intermediate position and for returning to said conveying means, from said second elevator means in said intermediate position, a tray with parts arrayed thereon.

4. Apparatus according to claim 3; in which said holding means includes a holding plate movable along said conveying line and having a tray-receiving cutout with an opening at one side of said conveying line facing toward said tray-accommodating station, and transfer means operative for moving an empty tray from said cutout of the holding plate on said conveying line through said opening onto said tray-accommodating station and for moving a tray with arrayed parts from said station back onto said conveying line.

5. Apparatus according to claim 4; in which said means for arraying the parts supplied to a tray at said station includes vibrating means for shaking said tray.

6. Apparatus according to claim 5; in which said means for arraying the parts supplied to a tray at said station includes means for inclining said tray so that the supplied parts flow across the vibrated tray in the direction in which the tray is inclined.

7. Apparatus according to claim 6; in which said parts supplying means includes means defining a receptacle for at least one type of parts, and gate means for controlling discharge of parts from said receptacle onto an empty tray at said station.

8. Apparatus according to claim 7; in which said parts supplying means includes a magazine defining a plurality of receptacles for containing respective types of parts and being rotatable to align a selected one of said receptacles with said gate means so that the type of parts discharged through the latter onto an empty tray at said station will be appropriate to the type of said tray.

9. Apparatus according to claim 8; further comprising sensor means for detecting said type of the tray on which parts are to be arrayed.

10. Apparatus according to claim 7; further comprising means for collecting surplus parts which flow off the vibrated tray at said station so that the collected parts may be returned to said receptacle.

11. Apparatus according to claim 2; further comprising sensor means associated with said first elevator means for causing operation of the latter when said sensor means detects the presence of an empty tray at said head end of the line on said elongated conveyor device.

12. Apparatus according to claim 2; in which said elongated conveyor device is inclined downwardly from said one end toward said other end for the gravity feed of said line of trays therealong, and said first elevator means includes a tray-receiving plate movable between a lowered position at said other end of the elongated conveyor device for receiving the tray at said head end of the line and said elevated position in which the tray on said tray-receiving plate is delivered to said holding means; and further comprising tray-stopping means movable by said tray-receiving plate between an inoperative position below said elongated conveyor device when said tray-receiving plate is in said lowered position and an operative position engageable with a tray next in said line from said head end upon movement of said tray-receiving plate to said elevated position for preventing further gravity feed of trays along the elevated conveyor device.

* * * * *